US006234898B1

(12) United States Patent
Belamant et al.

(10) Patent No.: US 6,234,898 B1
(45) Date of Patent: May 22, 2001

(54) METHOD AND APPARATUS FOR CONTROLLING A GAMING OPERATION

(76) Inventors: Serge Christian Pierre Belamant, 43 Carlisle Avenue, Hurlingham, Sandton, 2196; Gavin Shenker, 11 Viljoen Street, Rouxville, Johannesburg, 2192, both of (ZA)

( * ) Notice: Subject to any disclaimer, the term of this patent is extended or adjusted under 35 U.S.C. 154(b) by 0 days.

(21) Appl. No.: 09/077,110

(22) PCT Filed: Nov. 21, 1996

(86) PCT No.: PCT/GB96/02869

§ 371 Date: Aug. 3, 1998

§ 102(e) Date: Aug. 3, 1998

(87) PCT Pub. No.: WO97/19428

PCT Pub. Date: May 29, 1997

(30) Foreign Application Priority Data

Nov. 21, 1995 (ZA) ..... 95/9857

(51) Int. Cl.[7] ..... A63F 9/24

(52) U.S. Cl. ..... 463/25; 463/29; 463/40; 463/43; 463/16

(58) Field of Search ..... 463/17, 19, 20, 463/29, 16, 40, 43, 25

(56) References Cited

U.S. PATENT DOCUMENTS 4,764,666 8/1988 Bergeron .
4,882,473 * 11/1989 Bergeron et al. ..... 463/25
5,505,449 * 4/1996 Eberhardt et al. ..... 463/29
5,762,552 * 6/1998 Vuong et al. ..... 463/25
5,770,533 * 6/1998 Franchi ..... 463/42
5,800,269 * 9/1998 Holch et al. ..... 463/42
5,919,091 * 7/1999 Bell et al. ..... 463/25
5,951,397 * 9/1999 Dickinson ..... 463/36

FOREIGN PATENT DOCUMENTS 41 35 767 5/1993 (DE) .
0 360 613 3/1990 (EP) .
0 588 625 3/1994 (EP) .
0 596 760 5/1994 (EP) .
2 622 913 12/1989 (FR) .
2 267 772 12/1993 (GB) .
2 287 342 9/1995 (GB) .
92/10806 6/1992 (WO) .

* cited by examiner

*Primary Examiner*—Michael O'Neill
(74) *Attorney, Agent, or Firm*—Stroock & Stroock & Lavan LLP

(57) ABSTRACT

A system for controlling a gaming operation comprises a secure processing and memory apparatus in the form of a smart card, together with non-secure input and display means connectable to the smart card. The memory of the smart card stores software controlling the operation of the game and also data relating to gains or losses of the player. Input signals generated by the player are processed within the secure processor and all operations which can influence the outcome of the game are carried out within the secure processor so that the system is not susceptible to tampering, even when used in a non-secure environment. Thus, the system allows gaming to take place in hotel rooms and other non-secure locations, with secure betting and allocation of winnings.

19 Claims, 5 Drawing Sheets

METHOD AND APPARATUS FOR CONTROLLING A GAMING OPERATION

BACKGROUND OF THE INVENTION

This invention relates to a method of securely controlling a gaming operation and to a system and apparatus for implementing the method.

Games of chance in which a player actively participates in the game and can with money according to the outcome of the game are very popular. Such games are normally played in casinos or other controlled environments.

Electromechanical and electronic gaming apparatus is frequently used, but must generally also be located in a secure environment to prevent tampering with the apparatus. For example, in the case of an electronic gaming apparatus, a person with uncontrolled access to conventional equipment could monitor the flow of data in the equipment and interfere with its operation, for example, by transmitting false instructions to credit a player's account with winnings.

It is an object of the invention to provide a method of and apparatus for controlling a gaming operation which can be operated safely in a non-secure environment.

SUMMARY OF THE INVENTION

According to the invention there is provided a method of controlling a gaming operation in which a player bets on the outcome of a game, the method comprising:

providing secure apparatus comprising secure processor means and associated secure memory means;

storing in the secure memory means first data related to the control and operation of a game and second data relating to gains or losses of a player of the game;

transmitting input signals to the secure processor means from input means operated by the player; and transmitting output signals from the secure processor means to display means, wherein the result of the game and the allocation of gains or losses to the player are controlled by operations performed on the stored first and second data and on data derived from the input signals, in the secure apparatus.

Further according to the invention there is provided a system for controlling a gaming operation in which a player bets on the outcome of a game, the system comprising:

secure apparatus comprising secure processor means with associated secure memory means;

input means connectable to the secure processor means and operable by a player of a game to transmit input signals to the secure processor means;

display means connectable to the secure processor means for receiving output signals from the secure processor means representing a result of the game;

wherein the secure memory means stores first data related to the control and operation of a game and second data relating to gains or losses of the player, and wherein the result of the game and the allocation of gains or losses to the player are controlled by operations performed on the stored first and second data and on data derived from the input signals, in the secure apparatus.

The secure processor means and the secure memory means are preferably provided together on a "smart card" comprising a substrate supporting the processor and memory means, associated electronic circuitry, and contact means for permitting communication between the processor means and the input and display means.

The input means may be, for example, a keyboard of a computer, a keypad of a telephone, or a keypad on a dedicated games apparatus.

Alternatively, the input means may comprise a "touch screen" display, a mouse, or any other input with a sufficient number of output states.

The display means may comprise, for example, a television set, a video display unit or monitor, a liquid crystal display or another display.

The secure memory means may include first memory for storing software controlling and operating the game, and second memory storing results of the game and data representing the value of gains or losses of the player which is adjusted according to the outcome of the game.

The invention extends to the secure apparatus of the system.

DESCRIPTION OF EMBODIMENTS

Figure 1:
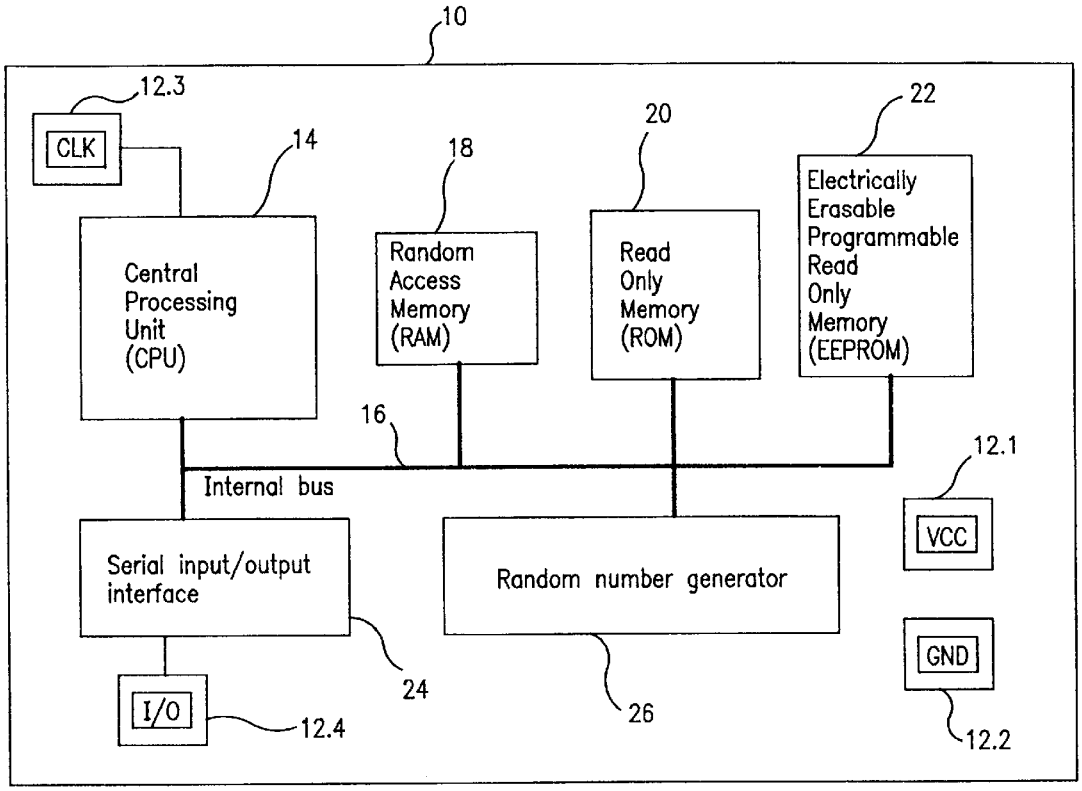
FIG. 1 is a simplified block schematic diagram of secure apparatus for controlling a gaming operation according to the invention.
Figure 2:
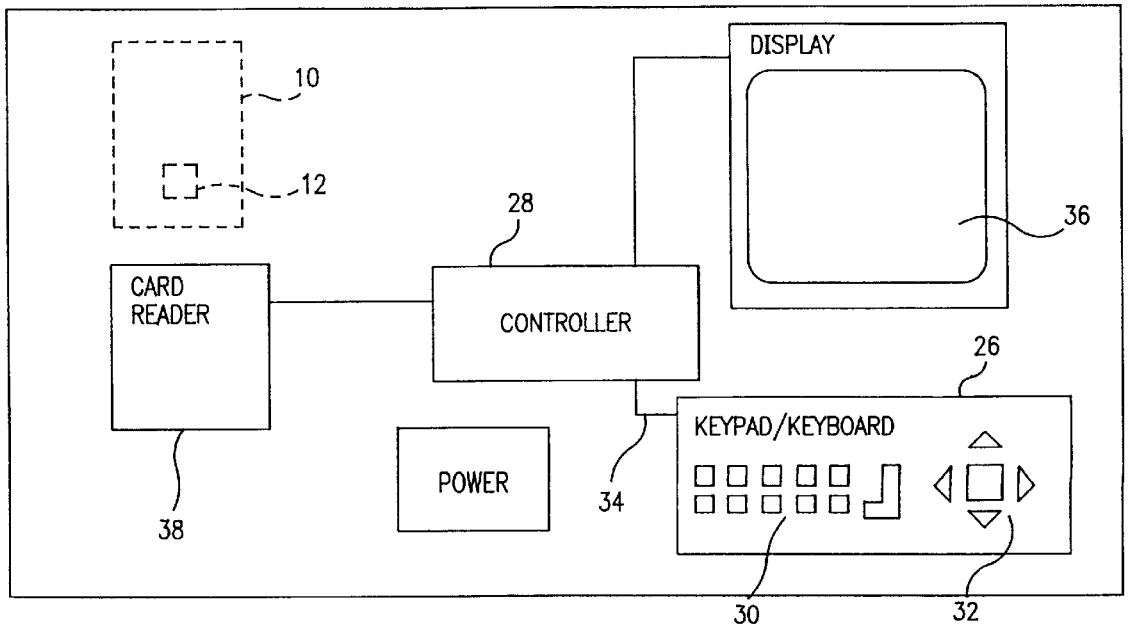
FIG. 2 is a block schematic diagram showing a gaming system in which the secure apparatus of FIG. 1 is used together with associated non-secure apparatus.

Referring first to FIGS. 1 and 2, the heart of the present invention is a secure apparatus comprising a "smart card" 10 with a contact pad 12. The circuitry of the smart card is illustrated in greater detail in FIG. 1, and includes a central processing unit (CPU) 14, which is connected via an internal bus 16 to associated random access memory (RAM) 18, read only memory (ROM) 20 and an electrically erasable programmable read only memory (EEPROM) 22. The CPU 14 is also connected via the bus 16 to a serial input/output interface 24 and a random number generator circuit 26. The contact pad 12 includes power supply contacts 12.1 and 12.2 which supply power to the circuitry of the smart card, a clock contact 12.3 connected to the CPU 14 which supplies an external clock signal to the circuitry, and an input/output (I/O) contact 12.4 allowing communication between the serial interface 24 and an external device.

The ROM 20 stores software which controls the operation of one or more games which can be played by a user of the apparatus, as well as controlling the management of winnings data relating to gains and losses for that player arising out of bets placed by the player on the outcome of a game. The RAM 18 temporarily stores data generated for the playing of the game, the abovementioned winnings data, and associated data. The EEPROM 22 stores data which may be changed from time to time, which may include a portion of the software stored in the ROM 20, or even the entire software, as well as the required operational parameters. For example, a portion of the software stored in the EEPROM 22 which may be adjusted from time to time could be used to enhance the functionally of the game. Alternatively, the data in the EEPROM could be adjusted to update the payout values of the game.

The simplified schematic diagram of FIG. 2 is an example of one embodiment of a gaming system which uses the smart-card based secure apparatus of FIG. 1 to implement a gaming operation. The system includes an input device in the form of a keypad or keyboard 26 which is connected to a microprocessor-based controller 28. In the prototype system, the keypad 26 is a dedicated unit, similar in appearance to a remote control for a television set and which has a numeric keypad 30 as well as cursor keys 32. The communication link 34 between the keypad 26 and the controller 28 may comprise a table but is preferably a wireless link, such as an infrared link.

Connected to the controller 28 is a display 36, which in the prototype system is a conventional television set. Thus, the output of the controller 28 is a modulated RF signal which can be received by a conventional television set. Obviously, depending of the nature of the display 36, the output of the controller 28 will vary.

Connected to the controller 28 is a smart card reader 38 which has contacts corresponding to the contact pad 12 on the smart card 10 which supplies the necessary power and clock signals to the smart card, and which permits communication between the I/O interface 24 of the smart card and the microprocessor of the controller 28.

It should be appreciated that the components of the system shown in FIG. 2, apart from the secure apparatus 10, need not be secure themselves, nor need they be located in a secure environment.

The operation of the system will now be described. The essence of the invention is that a gambling game, in which value is purchased to be bet by a player of a game using the secure apparatus and in which winnings accrue to or losses are debited from the player, depending on the outcome of the game, is operated securely in a non-secure environment. This is achieved by providing apparatus which has a secure processor and associated secure memory, with all crucial operation relating to the outcome of the game and the crediting of winnings or the debiting of losses to the player being carried out internally between the secure processor and the secure memory only. This prevents tampering with the apparatus, so that neither the outcome of the game nor the winnings or credit balance of the player can be tampered with.

In the prototype system, the game offered is five card poker. The described system allows a player to effectively deposit value into the secure apparatus, creating a credit balance, to place bets while playing the game offered (one or more times), and to accrue winnings (or losses) according to the outcome of each game. Eventually, the player can convert the winnings (if any) into value.

In the prototype system, a user of the system obtains a smart card 10 which is loaded with either a predetermined credit value or a credit value selected by the user, and which is either paid for or debited to an account of the player, for example in a club or hotel. The user inserts the smart card 10 into the card reader 38 of the system, which may be installed in a hotel room for example.

Figure 3:
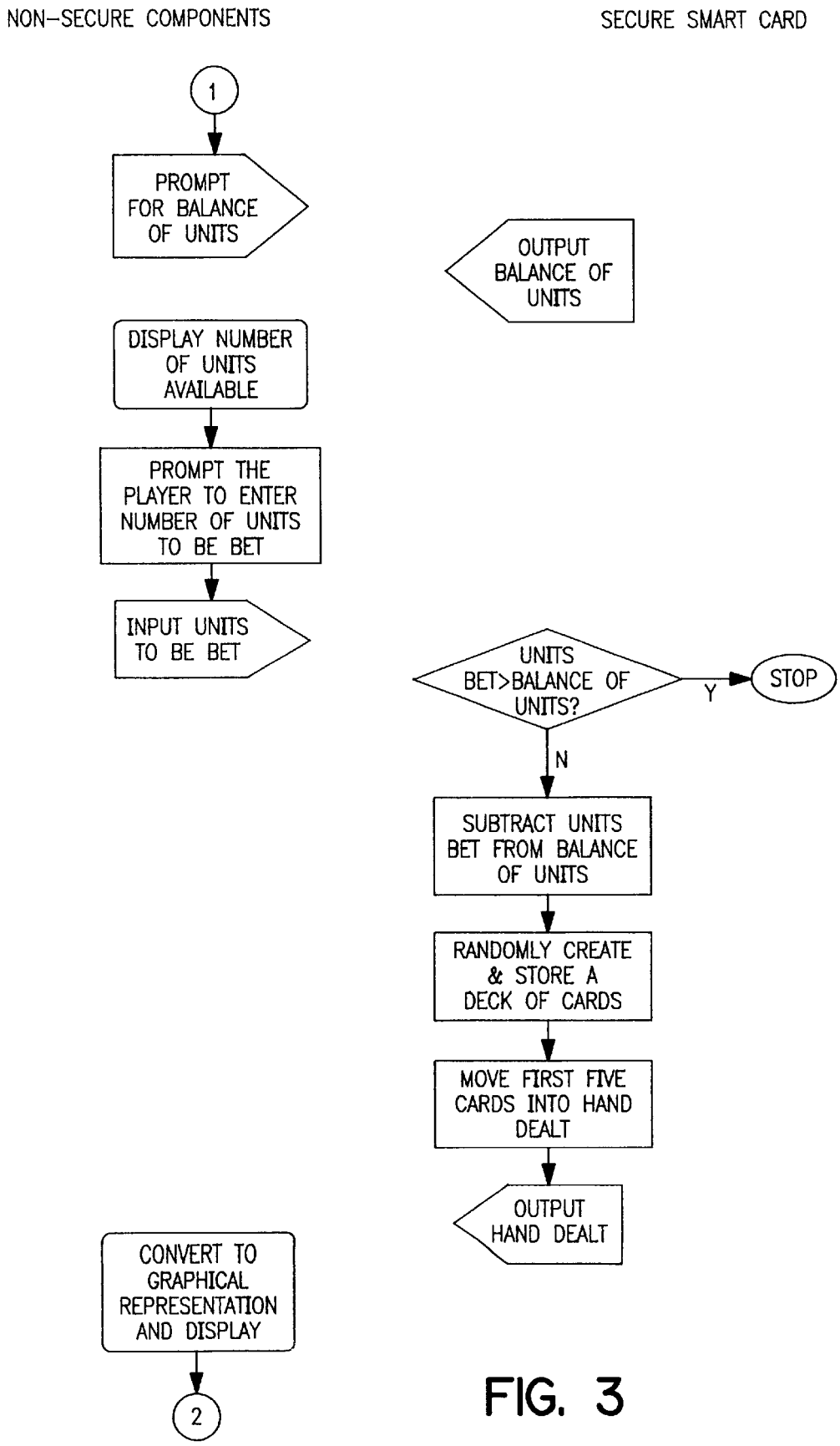
FIGS. 3 to 6 are flow charts indicating the operation of the secure apparatus with regard to the playing of a game of chance and the management of a credit balance of a player, with the corresponding operation of the non-secure apparatus indicated.

Referring now to the flow chart of FIG. 3, the CPU of the smart card reads and outputs the credit balance stored in the EEPROM 22 of the card to the controller 28 which generates a display on the display unit 36. This allows the user to see what the maximum possible bet is. The user then decides how much to bet on the game to be played, and inputs this figure via that keypad 26. The secure apparatus will not allow a bet greater than the credit balance available. The amount bet is deducted from the credit balance before the game commences.

A "deck of cards" is created by the software stored in the ROM 20 or the EEPROM 22 with the aid of the native random number generator circuit 26 and "shuffled" numerous times in order to ensure that the sequence of cards cannot be predicted. The first five cards from the deck of cards are moved into a "hand" dealt to the user and stored in the RAM 18, and five bytes of data representing the hand are output so that the hand is displayed to the user. The user can now decide which "cards" in the hand to retain or discard in order to attempt to improve the displayed hand.

Figure 4:
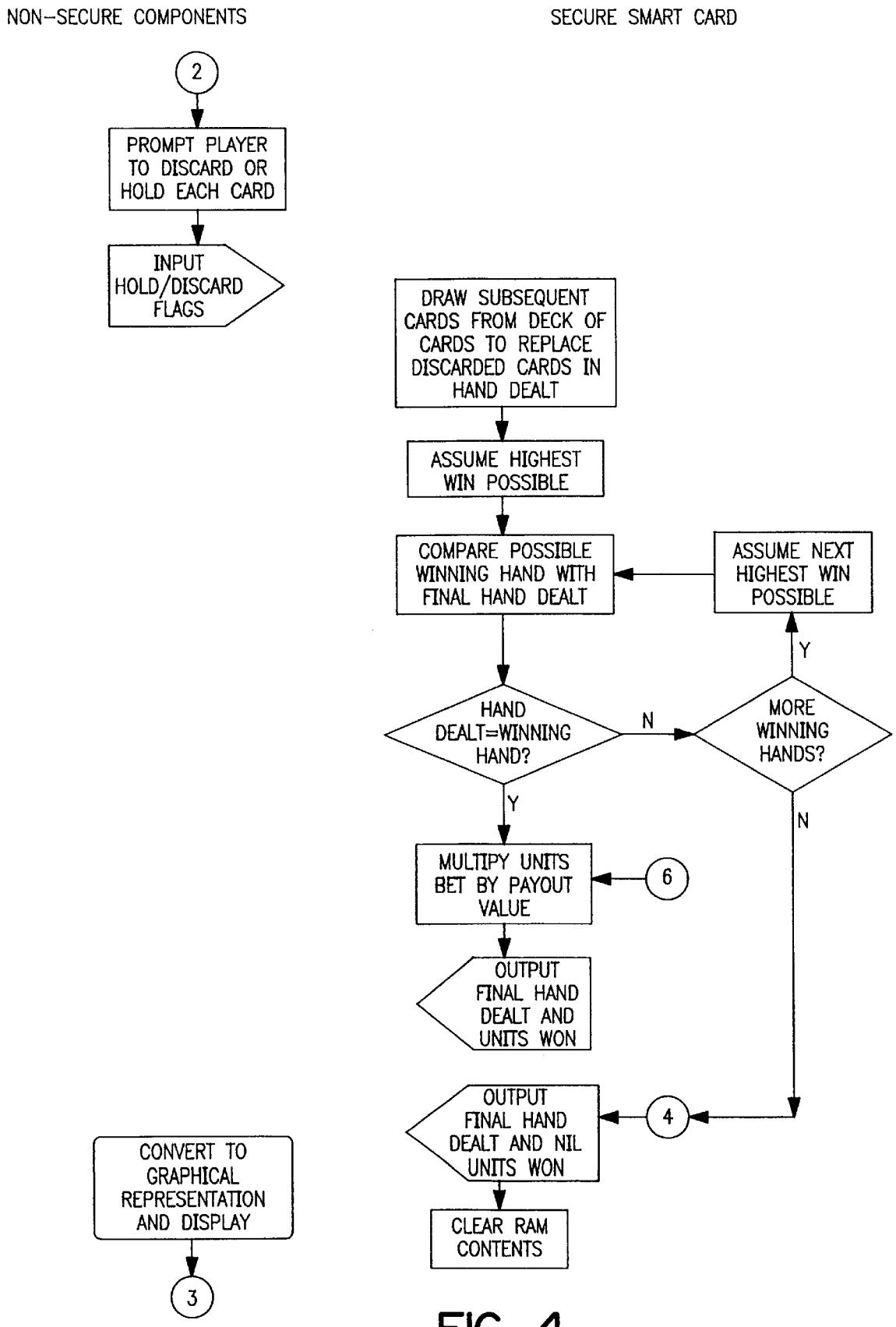

Referring now to FIG. 4, the user operates the keypad to indicate which cards are to be discarded or retained. This choice is indicated by five bytes, each of which relates to a card in the hand dealt and which could be either high or low values.

A high value indicates that the card in question must be retained, while a low value indicates that the card must be discarded. For each card that must be discarded, the next card within the deck of cards is moved into the vacated position within the hand dealt. This sequence of cards now becomes the final hand dealt and is compared by the CPU 14 to all possible winning bands, from the highest possible win downwards (eg. royal flush, four of a kind, . . . , two pairs, one pair).

As soon as the hand dealt is found to match a winning hand, a predetermined payout value (stored in the EEPROM 22) for that particular winning hand is multiplied by a value corresponding to the amount bet (units bet) and the result is stored in the RAM 18. If no winning hand is found, the whole of the RAM 18 is cleared, including the data corresponding to the amount bet (units bet). The bytes representing the final hand dealt and the remaining units bet are output to the display. If the units bet value is zero, a new game must be started and a new amount bet. Otherwise, the user can decide to double the units bet or to add them to the stored credit balance.

Figure 5:
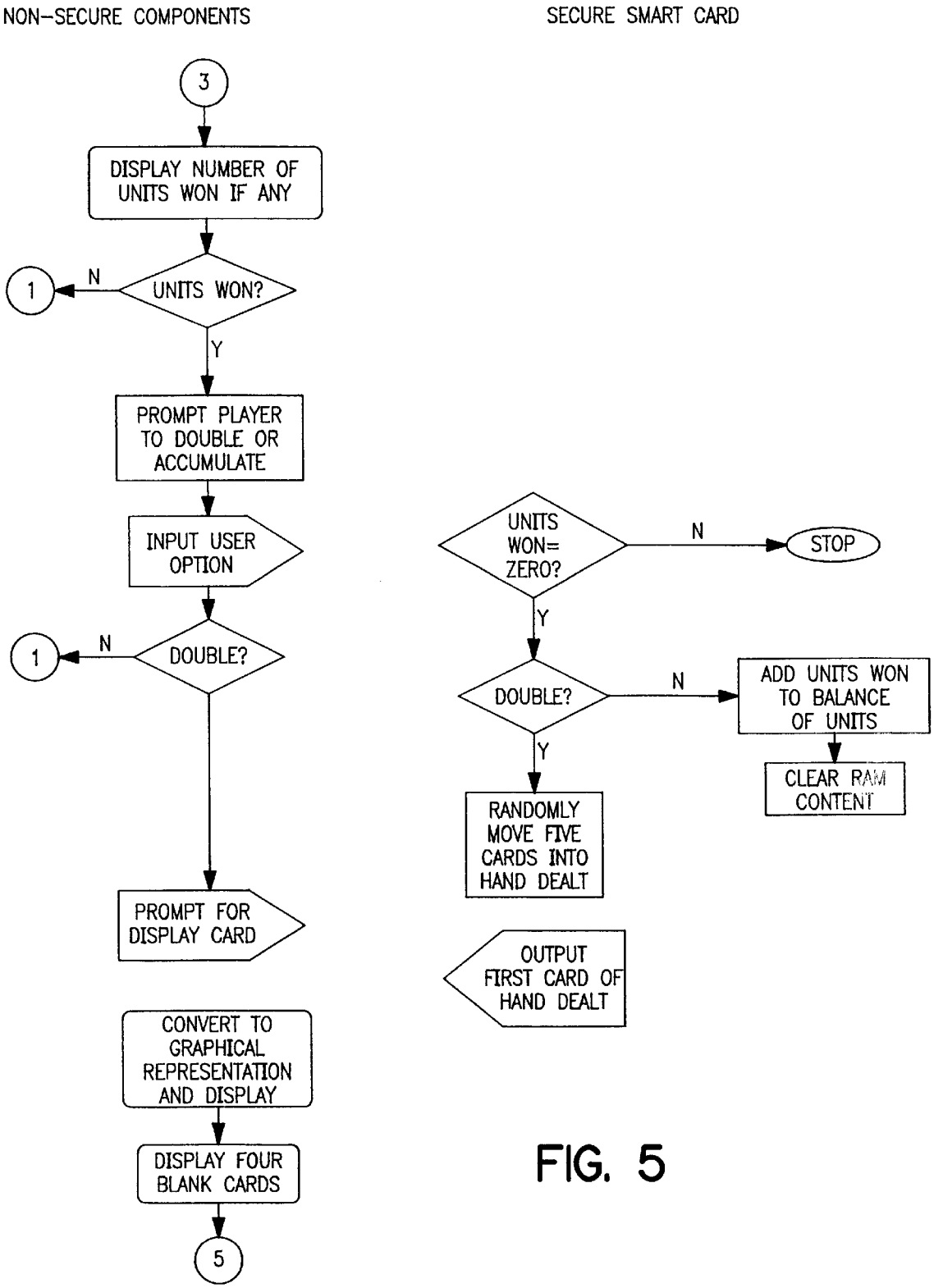
Figure 6:
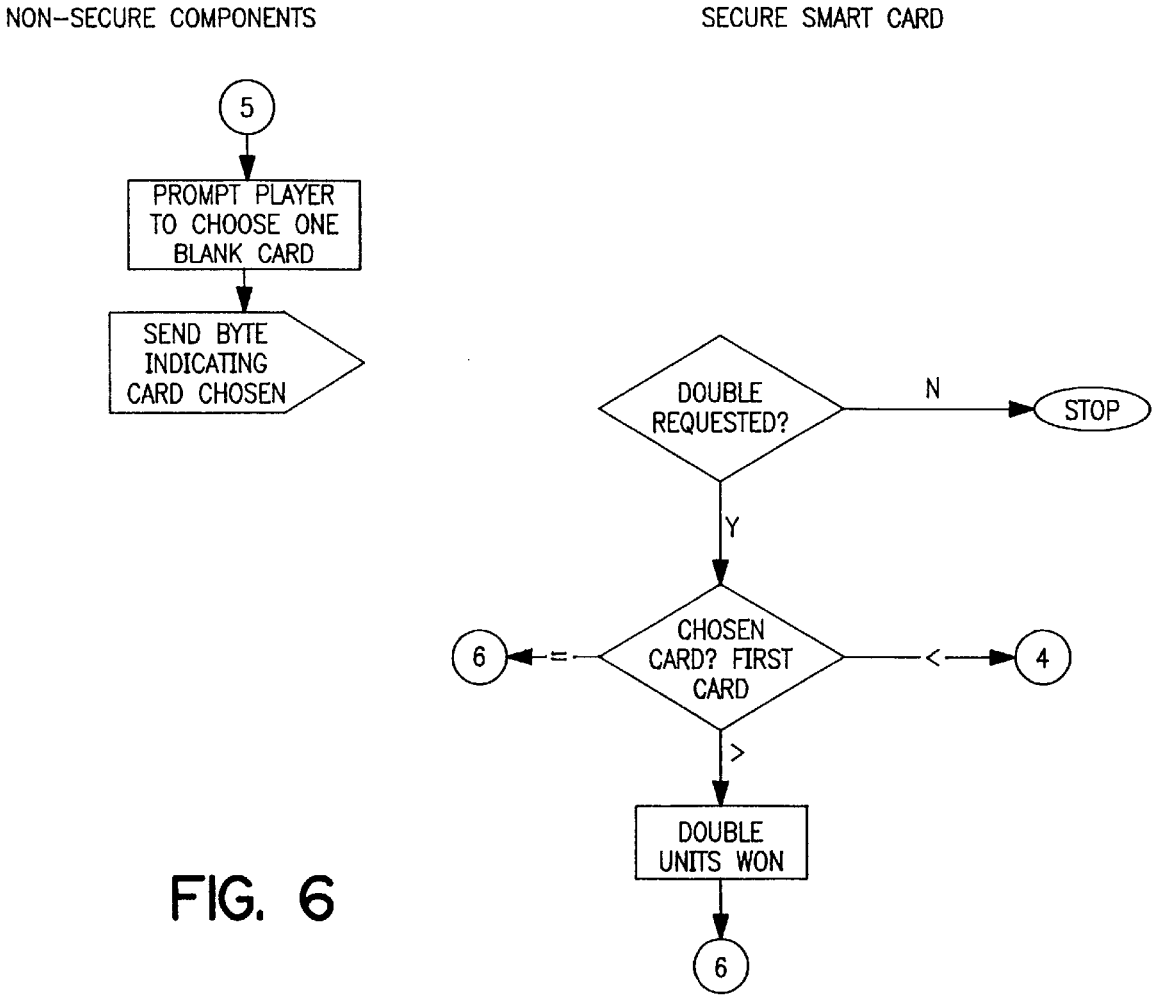

Referring to FIGS. 5 and 6, operation of the keypad by the user inputs a byte having a high value or a low value, depending on whether the user wishes to double the bet or to add the units bet value to the existing credit balance. Action is only taken by the CPU 14 if the units bet value is other than zero. If the byte has a low value, the units bet value is added to the credit balance and the whole of the RAM 18 including the units but register is cleared. If the byte has a high value, any five cards from the deck of cards are randomly moved into the hand dealt and only the first card of the hand dealt is output. This card is displayed, together with four blank cards. The user decides which of these blank cards might be higher or the same as the card displayed, and selects a card using the keypad 26, which inputs a byte with a value between one and four. An action is only taken on this byte if the user had previously requested a doubling of the bet.

The selected card is compared to the card output from the hand dealt. If the numerical value of the card chosen is greater than the numerical value of the card output, the units bet value is doubled. If the numerical value of the card chosen is equal to the numerical value of the card output there is no change to the units bet value. If the numerical value of the cards chosen is less than the numerical value of the card output, the whole of the RAM 18 including the units bet register is cleared.

The bytes representing the five cards including the card output stored in the hand dealt and the value remaining in the units but register are output and displayed. If no value remains in the units bet register, a new game must be started, or else the player can repeat the above process, either attempting to double the units bet value or adding the units bet value to the credit balance.

The flow charts of FIGS. 3 to 6 also illustrate the operations which are provided by the non-secure components of the system.

In the prototype system, the RAM 18 layout had the following configuration:

| | | |
|---|---|---|
| *Units bet | 4 bytes | Between 1 and JACKPOT units Indicates the amount of units bet or won. |
| *Deck of cards | 52 bytes | Each card of the deck is represented by 1 byte. |
| *Hand dealt | 5 bytes | Each card in the deal is represented by 1 byte. |

The byte representing each card is split into 2 nibbles i.e. the higher order nibble denoting the suit (eg 0001b=spades, 0010b=hearts, 0100b=diamonds and 1000b=clubs) and the low order nibble denoting the card within the suit (eg 0001b=ace, 0010b=two, 0011b=three . . . . 1010b=ten, 1011b=jack, 1100b=queen, 1101b=king). As an example the four of clubs would be represented by the byte 84b (10000100b) and the king of spades would be represented by the byte 1Dh (00011101b).

In the prototype system, the EEPROM 22 stores the necessary logic and algorithms required to emulate a standard five card poker game.

The layout of the rest of the EEPROM 22 for any game of chance could be as follows:

| | | |
|---|---|---|
| *Balance of units or credit balance | 4 bytes | Between 1 and 42 000 000 units |
| *Payout values | variable | These values depend on the game of chance being played and upon the return expected by the operator of the system. |

The balance of units field is updated every time a game is played, while the payout values are set before the card is issued to the user and would not normally be altered.

From the above description it will be apparent that, although there is communication between the secure processor of the smart card and external input and display means, this communication concerns only output signals from the secure processor which generates a display, and permissible control signals generated by the keypad or other input means which is operated by the user of the system. There is no bus or other communications link which is accessible to a would-be hacker or criminal which could be accessed to tamper or interfere with the operation of the system. Thus, the described invention allows for the secure operation of a gambling game in which money or its equivalent is won or lost, which can safely be used in a non-secure environment.

What is claimed is:

1. A method of controlling a gaming operation in which a player bets on the outcome of a game, the method comprising:

providing secure apparatus comprising secure processor means for controlling the gaming operation and associated secure memory means for storing data;

storing in the secure memory means software related to the control and operation of a game and data relating to gains or losses of the player of the game;

transmitting inputs signals to the secure processor means from input means operated by the player; and transmitting output signals from the secure processor means to display means, wherein the result of the game and the allocation of gains and losses to the player are exclusively controlled by operations performed by the software and the data derived from the input signals, in the secure apparatus.

2. A system for controlling a gaming operation in which a player bets on the output of the game, the system comprising:

secure apparatus comprising secure processor means for controlling the gaming operation with associated secure memory means for storing data;

input means selectively connectable to the secure processor means, the input means being connected to the secure processor means and operable by a player of a game to transmit input signals to the secure processor means during operation of the game;

display means connectable to the secure processor means for receiving output signals from the secure processor means representing a result of the game;

wherein the secure memory means stores software related to the control and operation of the game and data relating to gains or losses to the player, and wherein the result of the game and the allocation of gains or losses to the player are exclusively controlled by operations performed by the software and the data derived from the input signals, in the secure apparatus.

3. A system according to claim 2, wherein the secure processor means and the secure memory means are provided together on a "smart card" comprising a substrate supporting the secure processor means and the secure memory means, and contacts means for permitting communication between the secure processor means and the input and display means.

4. A system according to claim 2, wherein the input means is a keyboard of a computer, a keypad of a telephone, or a keypad on a dedicated games apparatus.

5. A system according to claim 2, wherein the input means comprises a "touch screen" display.

6. A system according to claim 2, wherein the input means comprises a mouse.

7. A system according to claim 2 wherein the display means comprises a television set, a video display unit or monitor or a liquid crystal display.

8. A system according to claim 2 wherein the secure memory means includes a first memory for storing the software, and a second memory for storing results of the game and the data representing the value of gains or losses of the player which is adjusted according to the outcome of the game.

9. Secure apparatus for use in a system for controlling a gaming operation in which a player bets on the outcome of a game, the secure apparatus comprising secure processor means with associated secure memory means, wherein the secure memory means stores software related to the control and operation of a game and data relating to gains or losses of the player, and wherein the result of the game and the allocation of gains or losses to the player are controlled by operations performed by the software and the data derived from the input signals, in the secure apparatus, the secure processor means being adapted for connection to input means operable by a player of a game to transmit input signals to the secure processor means, and further being adapted for connection to display means arranged to receive output signals from the secure processor means representing a result of the game.

10. The method of claim 1, wherein the data is representative of a credit value allocated to the player.

11. The method of claim 1, further comprising providing second processor means.

12. The method of claim 11, wherein the input signals to the secure processor means from the input means are transmitted via the second processor means to commence a game and to enter a bet and the method further comprising after the step of transmitting input signals:

reducing the credit value represented by the data by an amount corresponding to a bet may be the player.

13. The method of claim 11, wherein the output signals represent a result of the game and are transmitted via the second processor means and the method further comprising after the step of transmitting input signals:

increasing or reducing the credit value according to the outcome of the game.

14. The method of claim 13, wherein the increasing or reducing of the credit value are exclusively controlled within the secure apparatus.

15. The system of claim 2, further comprising second processor means.

16. The system of claim 15, wherein the input means is connectable to the secure processor means via the second processor means and operable by a player to commence a game.

17. The system of claim 15, wherein the display means is connectable to the secure processor means via the second processor means for receiving output signals.

18. The system of claim 2, wherein the second data is representative of a credit value allocated to the player and wherein the secure processor means operates to reduce the credit value by an amount corresponding to a bet made by the player, and to increase or decrease the credit value according to the outcome of the game to allocate gains and losses to the player.

19. The system of claim 9, wherein the data is representative of a credit value allocated to the player and wherein the secure processor means operates to reduce the credit value by an amount corresponding to a bet made by the player, and to increase or decrease the credit value according to the outcome of the game to allocate gains and losses to the player.

* * * * *